US006974158B1

(12) United States Patent
Westcott, Jr.

(10) Patent No.: US 6,974,158 B1
(45) Date of Patent: Dec. 13, 2005

(54) COVER AND INSERT ASSEMBLY FOR A PERIODICAL OR OTHER MULTI-PAGE PRINTED MATERIAL

(75) Inventor: Robert J. Westcott, Jr., Sanbornton, NH (US)

(73) Assignee: Concord Litho Group, Inc., Concord, NH (US)

( * ) Notice: Subject to any disclaimer, the term of this patent is extended or adjusted under 35 U.S.C. 154(b) by 25 days.

(21) Appl. No.: 10/435,571

(22) Filed: May 9, 2003

Related U.S. Application Data

(60) Provisional application No. 60/379,657, filed on May 9, 2002.

(51) Int. Cl.[7] ..... B42D 9/00
(52) U.S. Cl. ..... 281/29
(58) Field of Search ..... 281/15.1, 29, 31, 281/20, 38, 42; 402/80 R, 79.8 R; 40/124.06, 40/124.1; 283/63.1, 65; 206/39.5, 449

(56) References Cited

U.S. PATENT DOCUMENTS

| | | | | |
|---|---|---|---|---|
| 2,633,372 | A * | 3/1953 | Wilson | 281/42 |
| 3,092,400 | A * | 6/1963 | Smith | 281/19.1 |
| 3,554,438 | A | 1/1971 | Van Malderghem | |
| 3,560,025 | A | 2/1971 | Ostrander | |
| 3,722,564 | A * | 3/1973 | Croon | 206/311 |
| 3,734,155 | A * | 5/1973 | Stenger | 150/148 |
| 4,172,332 | A * | 10/1979 | Holes et al. | 40/726 |
| 4,313,557 | A | 2/1982 | Foffel | |
| 4,520,958 | A * | 6/1985 | Jones et al. | 229/72 |
| 4,640,413 | A * | 2/1987 | Kaplan et al. | 206/232 |
| 4,741,475 | A * | 5/1988 | Norman | 229/71 |
| 5,059,052 | A * | 10/1991 | Casper | 402/80 R |
| 5,098,127 | A | 3/1992 | Williamson et al. | |
| 5,108,346 | A * | 4/1992 | Ashby | 462/6 |
| 5,141,252 | A | 8/1992 | Michlin | |
| 5,230,501 | A | 7/1993 | Melton | |
| 5,318,222 | A * | 6/1994 | Bartlett | 229/72 |
| 5,407,233 | A | 4/1995 | Wilen | |
| 5,634,633 | A | 6/1997 | Graushar | |
| 5,713,605 | A * | 2/1998 | Pace et al. | 281/38 |
| 5,876,143 | A * | 3/1999 | Ong | 402/3 |
| 5,882,038 | A * | 3/1999 | Ong | 281/31 |
| 5,918,908 | A | 7/1999 | Barnett et al. | |
| 5,924,736 | A * | 7/1999 | Russo | 281/38 |
| 6,003,254 | A * | 12/1999 | Lorber | 40/124.06 |
| 6,016,907 | A | 1/2000 | Dreier | |
| 6,017,164 | A * | 1/2000 | Abbott | 402/73 |
| 6,024,508 | A * | 2/2000 | Lippeth et al. | 402/73 |
| 6,095,565 | A * | 8/2000 | Kramer | 281/42 |
| 6,206,602 | B1 * | 3/2001 | Yamamoto et al. | 402/73 |
| 6,302,388 | B1 | 10/2001 | Graushar et al. | |

(Continued)

FOREIGN PATENT DOCUMENTS

FR 1050913 * 9/1953

*Primary Examiner*—Boyer D. Ashley
*Assistant Examiner*—Mark Henderson
(74) *Attorney, Agent, or Firm*—Devine, Millimet & Branch; Paul C. Remus; Michelle Saquet Temple

(57) ABSTRACT

A cover and insert assembly includes a cover having a pocket or sleeve formed between cover sections. One or more inserts are held by friction and/or spot glue within the pocket or sleeve and are slidably removed from the pocket or sleeve through an outer edge of the cover. The cover and insert assembly can be used with periodicals, magazines or any other type of multi-page printed material.

8 Claims, 2 Drawing Sheets

U.S. PATENT DOCUMENTS 6,416,243 B1 * 7/2002 Castro ..... 402/73
6,481,754 B2 * 11/2002 Fabel ..... 283/116
D478,349 S * 8/2003 Capaci ..... D19/27
6,742,812 B2 * 6/2004 Ramella et al. ..... 283/67
6,761,498 B1 * 7/2004 Harris et al. ..... 402/73
6,764,242 B1 * 7/2004 Karten et al. ..... 402/73
6,776,437 B1 * 8/2004 Ho ..... 283/38
2002/0027089 A1 * 3/2002 Pettey ..... 206/308.1

* cited by examiner

COVER AND INSERT ASSEMBLY FOR A PERIODICAL OR OTHER MULTI-PAGE PRINTED MATERIAL

CROSS-REFERENCE TO RELATED APPLICATIONS

The present invention claims the benefit of U.S. Provisional Patent Application Ser. No. 60/379,657 filed on May 9, 2002, which is fully incorporated herein by reference.

TECHNICAL FIELD

The present invention relates to periodicals, magazines or other multi-page printed material and more particularly, to a cover and insert assembly for the multi-page printed material.

BACKGROUND INFORMATION

Removable supplements, such as booklets, pamphlets, cards, and other types of inserts, are often inserted into magazines or periodicals in addition to the material printed on the pages of the magazine. These inserts provide bonus material and/or additional advertising, which can be physically removed and used separately from the magazine itself. Often such materials are concealed within the magazine to pique the reader's curiosity and entice the reader to purchase the magazine.

Various techniques have been used to secure and conceal inserts in periodicals or magazines. For example, some inserts are directly bound into the magazine. These inserts are often immediately exposed to the reader's view when the magazine is opened. Other types of inserts have been concealed within pockets that are formed separate from the magazine and then bound within the magazine. To bind an insert or a pocket holding an insert in the magazine requires additional material and additional steps during the binding process. Thus, existing techniques for securing inserts into a magazine can add considerably to the cost of the magazine.

When inserts are secured using the techniques discussed above, the reader must first open the magazine to the appropriate location to remove the insert from the magazine. Moreover, these inserts often cannot be removed without causing some damage to the magazine or the insert.

Accordingly, there is a need for a cover and insert assembly that allows an insert to be substantially concealed within a cover of a magazine or periodical without interfering with the process of binding the pages of the magazine. There is also a need for a finished value-added product that provides easy access to the insert for the consumer with minimal damage to the magazine and the insert.

SUMMARY

To satisfy the needs discussed above, an insert is located within a sleeve formed in at least one of the covers. In accordance with one aspect of the present invention, a cover and insert assembly comprises front and back covers connected together at a spine section. At least one of the covers includes a sleeve formed therein. At least one insert is located in the sleeve, and the insert is slidably removable through an outer edge of the cover.

According to another aspect of the present invention, a cover and insert assembly comprises front and back covers formed from a sheet of material. At least first and second cover sections of the sheet of material are folded over to form one of the covers with a sleeve between the cover sections. At least one insert is located in the sleeve and held in place such that the insert is slidably removable through an outer edge of the cover forming the sleeve.

According to another aspect of the present invention, a periodical comprises front and back covers and multiple pages bound between said front and back covers. At least one of the covers includes a sleeve formed therein. At least one insert is located in the sleeve and is slidably removable through an outer edge of the cover.

According to a further aspect of the present invention, a method is provided for making a cover and insert assembly. The method comprises obtaining a sheet of material having printed cover surfaces and having first, second and third cover sections and obtaining at least one insert having printed insert surfaces. The insert is positioned against an inside surface of the second cover section. The first cover section is folded along a fold line such that the insert is sandwiched between the first and second cover sections. The first cover section is adhered to the second cover section such that the insert is held between the first and second cover sections and is slidably removable.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
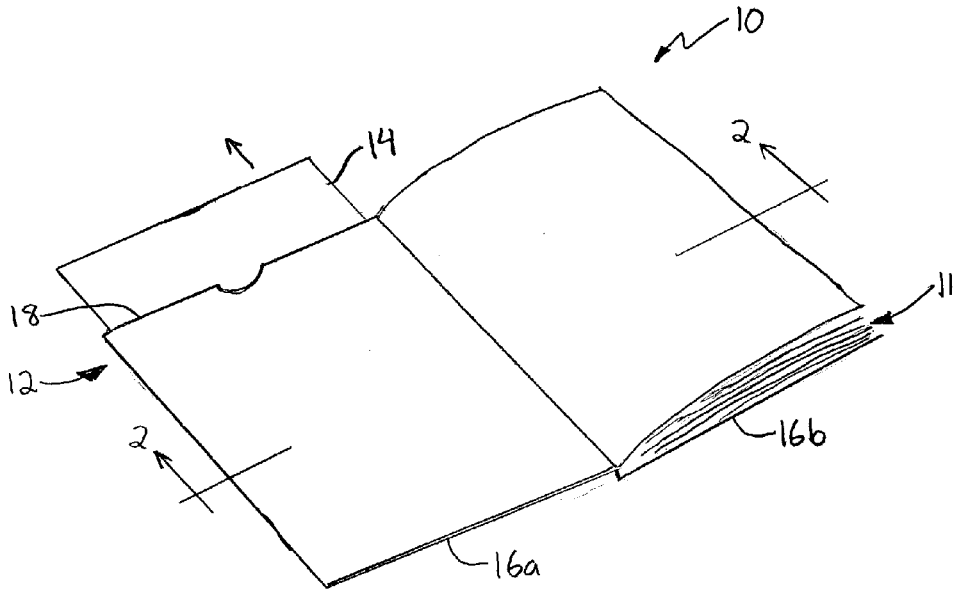
FIG. 1 is a perspective view of a magazine or periodical having a cover and insert assembly, according to one embodiment of the present invention, with the insert being removed.

Referring to FIG. 1, a periodical or magazine 10 having multiple pages 11 is shown having a cover and insert assembly 12, according to one embodiment of the present invention. One or more inserts 14 are located in a pocket or sleeve formed in at least one cover 16*a* of the magazine 10. The reader can remove the insert(s) 14 by sliding the insert(s) 14 through an outer edge 18 of the cover 16*a*. Although the exemplary embodiment shows the insert(s) 14 in the front cover 16*a*, one or more inserts 14 can similarly be formed in the back cover 16*b* instead of, or in addition to, the front cover 16*a*. The cover and insert assembly 12 can be used with any other type of multi-page printed material including, but not limited to, books, booklets or brochures. The insert(s) 14 can be a single sheet printed on one or both sides or can be folded or formed with multiple pages.

Figure 2:
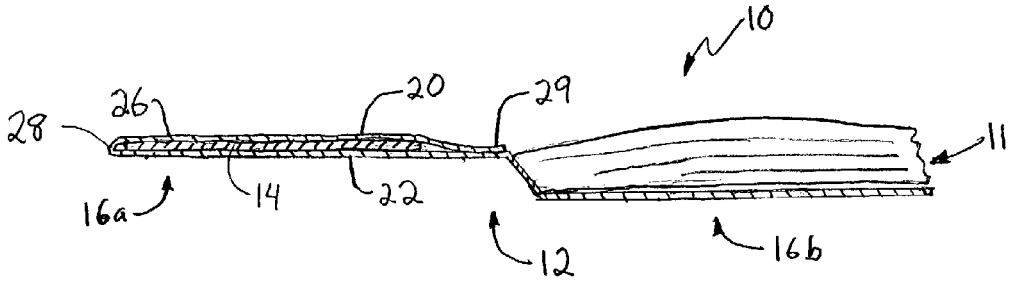
FIG. 2 is a cross-sectional view of the magazine or periodical shown in FIG. 1 taken along line 2—2.

As shown in greater detail in FIG. 2, the cover and insert assembly 12 includes first and second cover sections 20, 22 forming the pocket or sleeve 26 in the cover 16*a*. According to one embodiment, the first and second cover sections 20, 22 are folded along one side 28 of the cover 16*a* and adhered along at least the opposite side 29 of the cover 16*a* to form the pocket or sleeve 26. The cover sections 20, 22 preferably hold the insert(s) 14 in place by friction. Alternatively, the insert(s) 14 can be held in place by spot glue, for example, as required by the U.S. Postal Service for publication mailings. In one embodiment, the insert(s) 14 can be entirely concealed between the cover sections 20, 22. In another embodiment, a window (not shown) can be formed at any location in either one of the cover sections 20, 22 to allow the reader to view a portion of the insert(s) 14.

Figure 3:
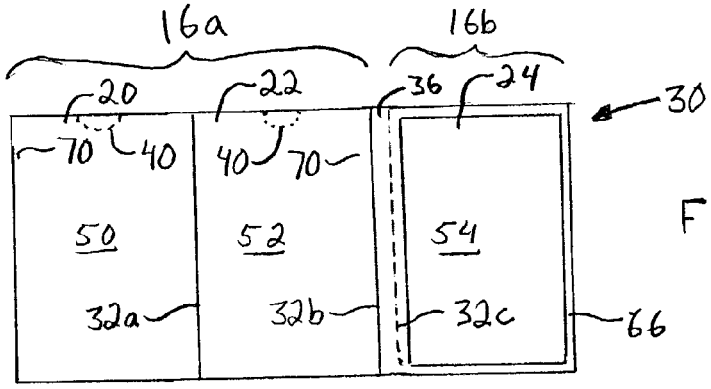
FIG. 3 is a plan view of a first side of a sheet of material used to form the cover, according to one embodiment of the present invention.
Figure 4:
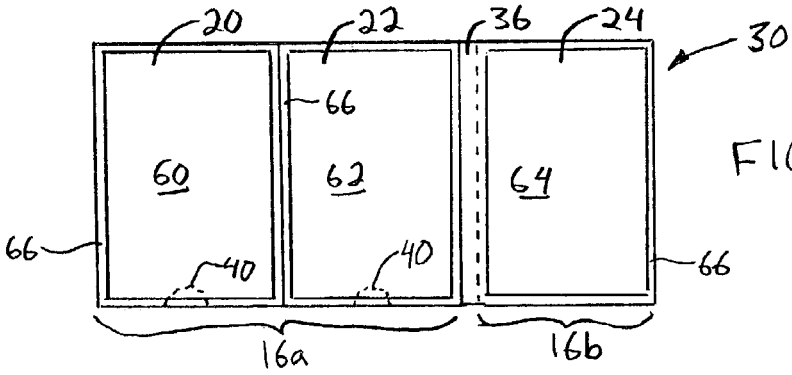
FIG. 4 is a plan view of a second side of the sheet of material shown in FIG. 3.

According to one preferred embodiment shown in FIGS. 3 and 4, the front and back covers 16*a*, 16*b* are formed from a single sheet 30. The sheet 30 is preferably cut from a roll of paper or other web material, as is known to those skilled in the art. The exemplary embodiment of the sheet 30 includes the first and second cover sections 20, 22 that form the cover 16*a* and a third cover section 24 that forms the cover 16*b*. To form the cover 16*a*, the first and second cover sections 20, 22 are folded along the fold line 32*a*. This embodiment of the sheet 30 also includes a spine section 36 between the second and third cover sections 22, 24. The spine section 36 forms the spine between the covers 16*a*, 16*b*, for example, when folded along fold lines 32*b*, 32*c*.

In one embodiment, certain surfaces on opposite sides of the sheet 30, as shown in FIGS. 3 and 4, can be printed on to form the printed inside and outside cover surfaces. On one side of the sheet 30 (FIG. 3), an inside back cover surface 54 is formed on the third cover section 24, and an inside front cover surface 60 is formed on the first cover section 20. On the other side of the sheet 30 (FIG. 4), outside front cover surface 62 is formed on the second cover section 22, and an outside back cover surface 64 is formed on the third cover section 24. In the exemplary embodiment, safe areas 66 surround the printed cover surfaces 54, 60, 62, 64 to provide a type safety margin, although this is not a limitation of the invention. Surfaces 50, 52 of the first and second cover sections 20, 22 form the inside of the sleeve 26 and do not require printing.

In one embodiment, a perforated section 40 is preferably formed adjacent at least one edge of the first and second cover sections 20, 22 to allow removal of the insert(s) 14 concealed by the cover sections 20, 22. Although the exemplary embodiment shows the perforated section 40 at the top edges of the first and second cover sections 20, 22, perforated sections 40 can also be formed at the bottom edges of the cover sections 20, 22. The perforated section 40 is preferably visible on the outside front cover surface 62 of the front cover 16*a* to indicate to the reader that the insert(s) 14 can be pulled out. Alternatively, another type of tear-away section can be formed in one or both of the cover sections 20, 22 to allow removal of the insert(s) 14.

In another alternative, a cut-out section (not shown) can be formed adjacent at least one edge of one or both of the cover sections 20, 22. The edge of the insert(s) 14 is positioned in the cut-out section to allow removal of the insert(s) 14 without tearing the cover 16*a*. The cut-out section can also act as a window allowing the reader to view a portion of the insert(s) 14.

Figure 5:
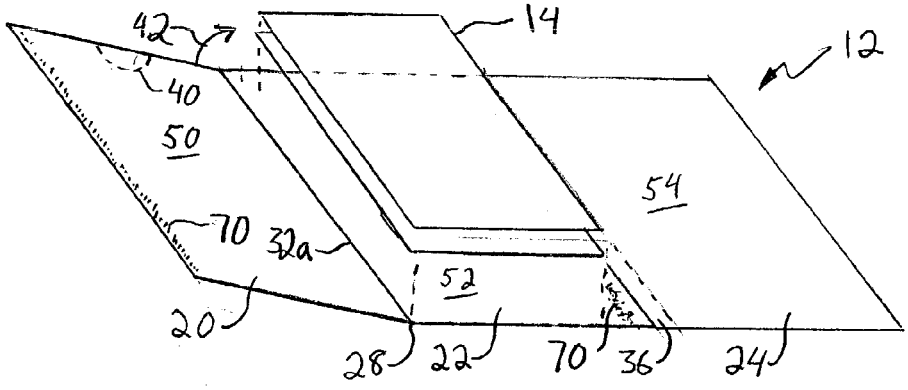
FIG. 5 is a perspective view of one embodiment of the cover and insert assembly being assembled.
Figure 6:
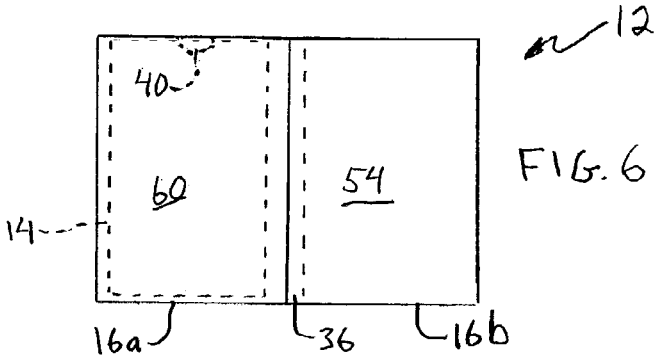
FIG. 6 is a plan view of one embodiment of the assembled cover and insert assembly.

Referring to FIGS. 5 and 6, one method for assembling the cover and insert assembly 12 is described in greater detail. As mentioned above, the sheets 30 are printed and cut from a roll of paper or web material using equipment and techniques known to those skilled in the art. The inserts 14 can similarly be formed from sheets cut from a roll of paper or other suitable web material with one or both sides of the inserts 14 printed. In one embodiment, the sheets 30 and inserts 14 can be printed and cut from the same roll of material. Alternatively, the inserts 14 can be formed from other types of materials.

The one or more inserts 14 are positioned against the inside surface 52 of the second cover section 22 of the sheet 30 (see FIG. 5). The one or more inserts 14 are preferably positioned such that a portion of each insert 14 overlaps the perforated section 40 (or cut-out section). The first cover section 20 is folded along fold line 32*a*, as shown generally by the arrow 42, such that the one or more inserts 14 are sandwiched between the first and second cover sections 20, 22.

To secure the cover sections 20, 22, adhesive 70 is applied to the second cover section 22 and/or the first cover section 20 (see FIG. 3). The adhesive 70 is preferably applied in a location to adhere the cover sections 20, 22 (e.g., along the sides) without adhering to the insert(s) 14 sandwiched between the cover sections 20, 22. Although the adhesive 70 is preferably a strip applied at one side of the cover sections 20, 22, as shown, the adhesive 70 can also be applied in sections or in other locations (e.g., at the bottom) of the cover sections 20, 22. One example of the adhesive 70 is hot melt glue. In one embodiment, spot glue can be used to adhere the insert(s) 14.

The length of each cover section 20, 22, 24 is preferably the same (e.g., about 7.437") but the widths of the cover sections 20, 22, 24 may vary. For example, the first cover section 20 (e.g., about 4.9375") can be slightly narrower than the second cover section 22 (e.g., about 5"), which can be slightly narrower than the third cover section 24 (e.g., about 5.375"). The first cover section 20 is preferably narrower than the second cover section 22 to allow the cover sections 20, 22 to be adhered without interfering with the folding at fold line 32*a*. The third cover section 24 forming-the back cover 16*b* is preferably wider to allow it to be trimmed without having to trim the front cover 16*a* that forms the pocket or sleeve. In one example, the safe areas 66 surrounding the printed surfaces have a width of about 0.25" and the spine section 36 has a width of about 0.3125". In this example, each insert 14 has about the same length as the cover sections 20, 22, 24 but has a shorter width of about 4.5". These dimensions are for exemplary purposes only and are not a limitation on the present invention.

The exemplary embodiment illustrates a single cover and insert assembly 12 made from the sheet 30. Alternatively, multiple cover and insert assemblies 12 can be made from a single sheet 30 and then separated.

According to one example, the cover and insert assembly 12 can be assembled using a web press with in-line finishing, as is well known to those of ordinary skill in the art. After the cover and insert assembly 12 is formed, the pages 11 (see FIG. 1) can be bound within the cover and insert assembly 12 using binding techniques known to those skilled in the art. Because the one or more inserts 14 are incorporated into the cover 16*a*, additional steps are not required to bind the insert(s) 14 with the pages 11. Also, the use of cover 16*a* to form the sleeve minimizes the use of additional material.

In use, the reader can easily remove the inserts 14 by pinching the perforated section 40 together with the insert(s) 14 beneath the perforated section 40. The reader pulls the perforated section 40 to detach the perforated section 40 and simultaneously slide the insert(s) 14 out of the pocket or sleeve 26. Where a cut-out section is used, the reader pinches the insert(s) 14 directly. Because the insert(s) 14 can be removed through an outer edge of the cover 16*a*, the insert(s) 14 can be removed quickly without having to open the magazine to any particular location. Because the insert(s)

14 are preferably held in place by friction and/or spot glue, the insert(s) can be removed without causing significant damage to the magazine or the insert.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A cover and insert assembly comprising:

front and back covers connected together at a spine section, wherein at least one of said covers includes a sleeve formed therein wherein said cover with said sleeve includes a tear-away section located at said outer edge of said cover; and at least one insert located in said sleeve, wherein said insert is slidably removable through an outer edge of said cover with said sleeve wherein part of said at least one insert is positioned under said tear-away section such that a user can simultaneously tear out said tear-away section and remove said at least one insert.

2. A cover and insert assembly comprising:

front and back covers connected together at a spine section, wherein at least one of said covers includes a sleeve formed therein wherein said cover with said sleeve includes a tear-away section located at said outer edge of said cover wherein said tear-away section is perforated; and at least one insert located in said sleeve, wherein said insert is slidably removable through an outer edge of said cover with said sleeve wherein part of said at least one insert is positioned under said tear-away section such that a user can simultaneously tear out said tear-away section and remove said at least one insert.

3. A cover and insert assembly comprising:

front and back covers formed from a sheet of material, wherein at least first and second cover sections of said sheet of material are folded over to form one of said covers with a sleeve between said cover sections wherein said cover with said sleeve includes a tear-away section located at said outer edge of said cover; and at least one insert located in said sleeve and held in place such that said insert is slidably removable through an outer edge of said cover forming said sleeve wherein part of said at least one insert is positioned under said tear-away section such that a user can simultaneously tear out said tear-away section and remove said at least one insert.

4. A periodical comprising:

front and back covers, wherein at least one of said covers includes a sleeve formed therein wherein said cover with said sleeve includes a tear-away section located at said outer edge of said cover;

at least one insert located in said sleeve, wherein said insert is slidably removable through ar ed of said cover with said sleeve wherein part of said at least one insert is positioned under said tear-away section such that a user can simultaneously tear out said tear-away section and remove said at least one insert; and multiple pages bound between said front and back covers.

5. A cover and insert assembly comprising:

front and back covers connected together at a spine section, wherein at least one of said covers includes a sleeve formed therein; and at least one insert located in said sleeve, wherein said insert is slidably removable through an outer edge of said cover with said sleeve and wherein said cover with said sleeve includes a tear-away section located at said outer edge of said cover, and wherein part of said at least one insert is positioned under said tear-away section such that a user can simultaneously tear out said tear-away section and remove said at least one insert.

6. A cover and insert assembly comprising:

front and back covers connected together at a spine section, wherein at least one of said covers includes a sleeve formed therein; and at least one insert located in said sleeve, wherein said insert is slidably removable through an outer edge of said cover with said sleeve and wherein said cover with said sleeve includes a tear-away section located at said outer edge of said cover, and wherein part of said at least one insert is positioned under said tear-away section such that a user can simultaneously tear out said tear-away section and remove said at least one insert and wherein said tear-away section is perforated.

7. A cover and insert assembly comprising:

front and back covers formed from a sheet of material, wherein at least first and second cover sections of said sheet of material are folded over to form one of said covers with a sleeve between said cover sections; and at least one insert located in said sleeve and held in place such that said insert is slidably removable through an outer edge of said cover forming said sleeve and wherein said cover with said sleeve includes a tear-away section located at said outer edge of said cover, and wherein part of said at least one insert is positioned under said tear-away section such that a user can simultaneously tear out said tear-away section and, remove said at least one insert.

8. A periodical comprising:

front and back covers, wherein at least one of said covers includes a sleeve formed therein;

at least one insert located in said sleeve, wherein said insert is slidably removable through an outer edge of said cover with said sleeve and wherein said cover with said sleeve includes a tear-away section located at said outer edge of said cover, and wherein part of said at least one insert is positioned under said tear-away section such that a user can simultaneously tear out said tear-away section and remove said at least one insert; and multiple pages bound between said front and back covers.

* * * * *